US006745858B1

(12) United States Patent
Estes

(10) Patent No.: US 6,745,858 B1
(45) Date of Patent: Jun. 8, 2004

(54) ADJUSTABLE EARTH BORING DEVICE

(75) Inventor: Roy D. Estes, Weatherford, TX (US)

(73) Assignee: Rock Bit International, Fort Worth, TX (US)

( * ) Notice: Subject to any disclaimer, the term of this patent is extended or adjusted under 35 U.S.C. 154(b) by 0 days.

(21) Appl. No.: 10/209,832

(22) Filed: Aug. 1, 2002

Related U.S. Application Data

(60) Provisional application No. 60/314,808, filed on Aug. 24, 2001.

(51) Int. Cl.[7] ..... E21B 10/26
(52) U.S. Cl. ..... 175/384; 299/85.2
(58) Field of Search ..... 175/342, 382, 175/384; 299/85.2

(56) References Cited

U.S. PATENT DOCUMENTS 1,068,374 A * 7/1913 Tilson ..... 175/384
1,861,928 A * 6/1932 Loeffelman ..... 408/164
3,627,068 A * 12/1971 Wagnon et al. ..... 175/342
5,979,574 A 11/1999 Osadchuk
6,298,929 B1 10/2001 Cobos Rojas
6,427,791 B1 * 8/2002 Glowka et al. ..... 175/413
6,619,756 B1 * 9/2003 Holl et al. ..... 299/85.2

* cited by examiner

*Primary Examiner*—William Neuder
(74) *Attorney, Agent, or Firm*—Law Office of Tim Cook P.C.

(57) ABSTRACT

An adjustable earth boring device for provides a strong, easy to use, adjustable mount for cutters on earth boring devices. In a preferred embodiment, the device includes a grooved, wedge-shaped pocket and matching cutter segment with means to secure the cutter segment in the pocket. The wedge shaped pocket in the boring head is axially aligned with the boring device. Each side of the pocket has deep grooves somewhat resembling bolt threads. A slot in the rear of the pocket receives a bolt to secure the segment tightly in place. Threaded holes in the bottom of the pocket receive bolts through the cutter segment for a back up securing means. The cutter segment has a rolling cone cutter or series of blades or picks for cutting earth formations on the head end and a wedge shaped mounting body supporting it. The grooves are constructed such that the segments can be mounted at differing heights from the centerline of the boring head, thus determining the diameter which the boring device will cut. In another preferred embodiment, the pocket and the segment each define substantially parallel sides having locking, angled threads separated by installation grooves.

20 Claims, 10 Drawing Sheets

FIG. 7C
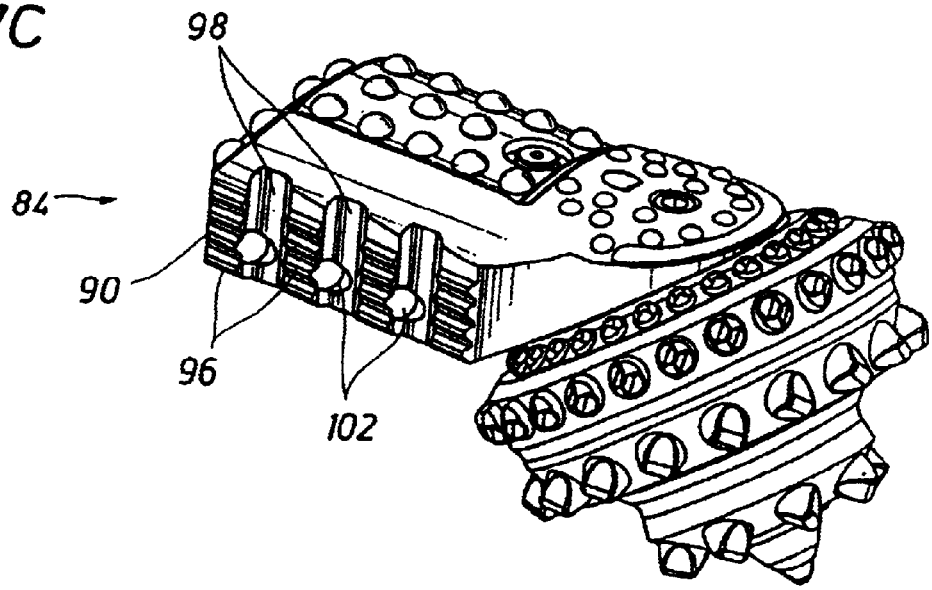
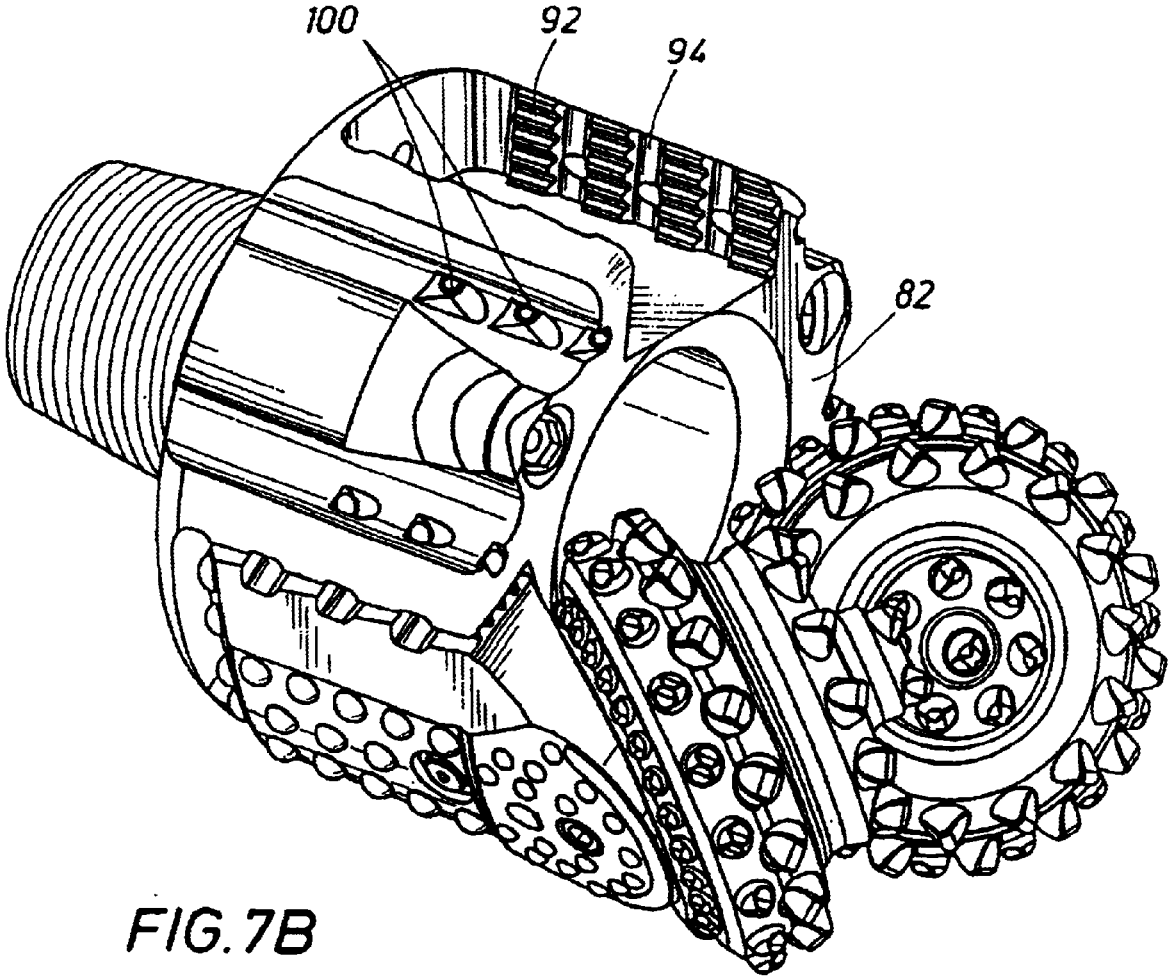
FIG. 7B

ADJUSTABLE EARTH BORING DEVICE

This application claims the benefit of Provisional Application Ser. No. 60/314,808 filed Aug. 24, 2001.

This application is related to Application Ser. No. 60/283,686, filed simultaneously herewith, and titled Roller Cone Bi-Center Bit.

BACKGROUND OF THE INVENTION

1. Field of the Invention

The present invention relates generally to earth boring devices and, more particularly, to an adjustable earth boring device which provides a strong, easy to use, adjustable mount for cutters on the device.

2. Description of the Prior Art

Earth boring devices have been in use for years for such applications as well drilling and the like. Typically, earth boring devices fall within the categories of rock bits, hole openers, and reamers. Such earth boring devices are usually made in segments and then welded together. Alternatively, in the utility horizontal boring industry, hole openers or reamers are usually made from segments of cut down tri-cone rock bits. Segments from the cut down bits are then mounted on a shaft or body that has proper box or pin connections. The boring devices so mounted are positioned so as to define a desired hole diameter and usually welded securely in place on the body.

Osadchuk, in U.S. Pat. No. 5,979,574, described a horizontal boring device having wedge shaped pockets and segments to allow removable cutting segments to be used. Unfortunately, the segments are pinned to a predetermined position on an axial member, and are not adjustable to permit boring holes of a desired different diameter. On the other hand, some oil field reamers use an adjustable wedging device and plate shims to adjust gage diameter to compensate for wear.

One problem with conventional earth boring devices is that most such devices are designed and built to bore only one size hole. Further, repair and replacement of components on such devices is very difficult due to their being welded together from segments. On the other hand, those products that are designed to be adjustable are weak or cumbersome to work with.

While these devices may be suitable for the particular purpose for which they are designed, they do not provide a strong, easy to use, adjustable mount for cutters on earth boring devices. In these respects, the adjustable earth boring device according to the present invention substantially departs from the conventional concepts and designs of the prior art, and in so doing provides an apparatus primarily developed for the purpose of providing a strong, easy to use, adjustable mount for cutters on earth boring devices.

SUMMARY OF THE INVENTION

The present invention provides a new adjustable earth boring device construction which provides a strong, easy to use, adjustable mount for cutters on earth boring devices. In a first preferred embodiment, the boring device of the present invention generally comprises a grooved wedge shaped pocket and a matching cutter segment with means to secure the cutter segment in the pocket. The wedge shaped pocket in the boring head is axially aligned with the boring device. Each side of the pocket has deep grooves somewhat resembling bolt threads. There may be provided a slot in the rear of the pocket for a bolt that secures the segment tightly in place. Further, there may be provided additional threaded holes in the bottom of the pocket for a back up securing means.

In another preferred embodiment, the pocket is not wedge shaped, but rather defines parallel axial grooved side walls. Vertical, i.e. substantially radial installation grooves cut across the axial grooves to permit easy installation and removal of the removable segment. Retaining wedges are then provided to retain the segment in place.

The cutter segment has a rolling cone cutter or series of blades or picks for cutting earth formations on the head end and a wedge shaped mounting body supporting it. The mounting body of the cutter segment has grooves that mate with the pocket grooves. The grooves are constructed such that the segments can be mounted at differing heights from the centerline of the boring head, thus determining the diameter which the boring device will cut. The back end of the segment has a threaded hole for the securing bolt that locks the segment into the pocket. There are bolt holes through the segment for a secondary securing device. The main locking device is a bolt that goes through the slot in the back of the pocket and into the rear of the segment. When tightened, it pulls the segment very securely into the pocket. After the segment is locked into place, additional bolts through segment and into holes in the bottom of the pocket provide a secondary or safety lock.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a adjustable earth boring device that will overcome the shortcomings of the prior art devices.

An object of the present invention is to provide a adjustable earth boring device for providing a strong, easy to use adjustable mount for cutters on earth boring devices.

Another object is to provide a adjustable earth boring device that can be easily adjusted to bore differing hole sizes in earth formations.

Another object is to provide a adjustable earth boring device that allows differing types of boring cutters to be easily exchanged on the same boring head.

Another object is to provide a adjustable earth boring device that allows easy field replacement of damaged cutters on earth boring devices.

Another object is to provide a adjustable earth boring device that holds boring cutters very securely on the boring head and still allows them to be adjusted or replaced easily.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 7*b* is a perspective view of a body of an earth boring device with a pocket defining non-tapering sides.

FIG. 7*c* is a perspective view of a replaceable segment adapted to fit within the pocket of FIG. 7*b*.

DESCRIPTION OF THE PREFERRED EMBODIMENT

Figure 1:
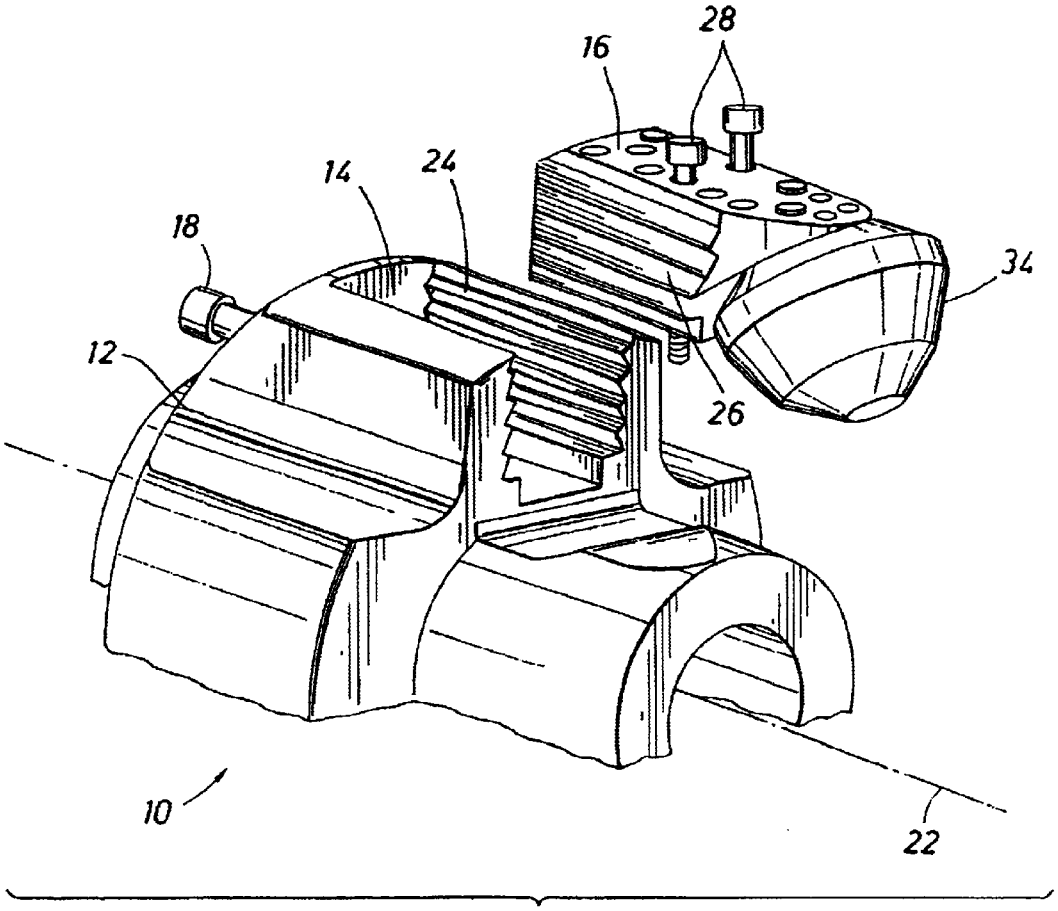
FIG. 1 is a perspective view of a portion of an earth boring device of this invention showing an adjustable pocket and segment.
Figure 1A:
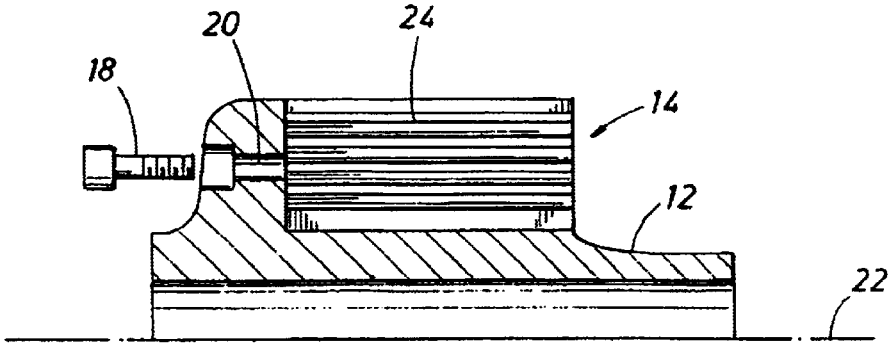
FIG. 1*a* is a side section view of the device of FIG. 1.

Turning now to the drawings, in which similar reference characters denote similar elements throughout the several views, the attached figures illustrate an adjustable earth boring device 10, only a portion of which is illustrated in FIG. 1 for clarity. The earth boring device 10 comprises a body or boring head 12 into which is formed a grooved, wedge-shaped pocket 14 and at least one mating cutter segment 16. The cutter segment 16 includes means to secure the cutter segment in the pocket, such as for example a bolt 18 which penetrates through the body 12 by way of an elongated slot 20 and which screws into the cutter segment 16. This feature of the invention is also illustrated in section view in FIG. 1*a*.

For safety, the bolt 18 should be of high grade steel and should be as large as practical. Bolts are used as locking devices because of their strength and simplicity. In this application, they are used in tension. Other devices can be used and may be necessary in some applications.

The wedge-shaped pocket 14 in the body 12 is aligned with an axis 22 of the boring device 10. The pocket 14 has laterally extending grooves 24, somewhat resembling bolt threads. The cutter segment 16 defines complementary grooves 26, which are also laterally extending in order to mate with the grooves 24 for a tight, friction fit. The cutter segment 16 may have a rolling cone cutter 34 or series of blades or picks, described below in greater detail, for cutting earth formations on the head end supported by the cutter segment 16. The rolling cone cutter 34 is illustrated in FIG. 1 without cutting teeth in order to more distinctly focus on the salient features of the invention.

Figure 2:
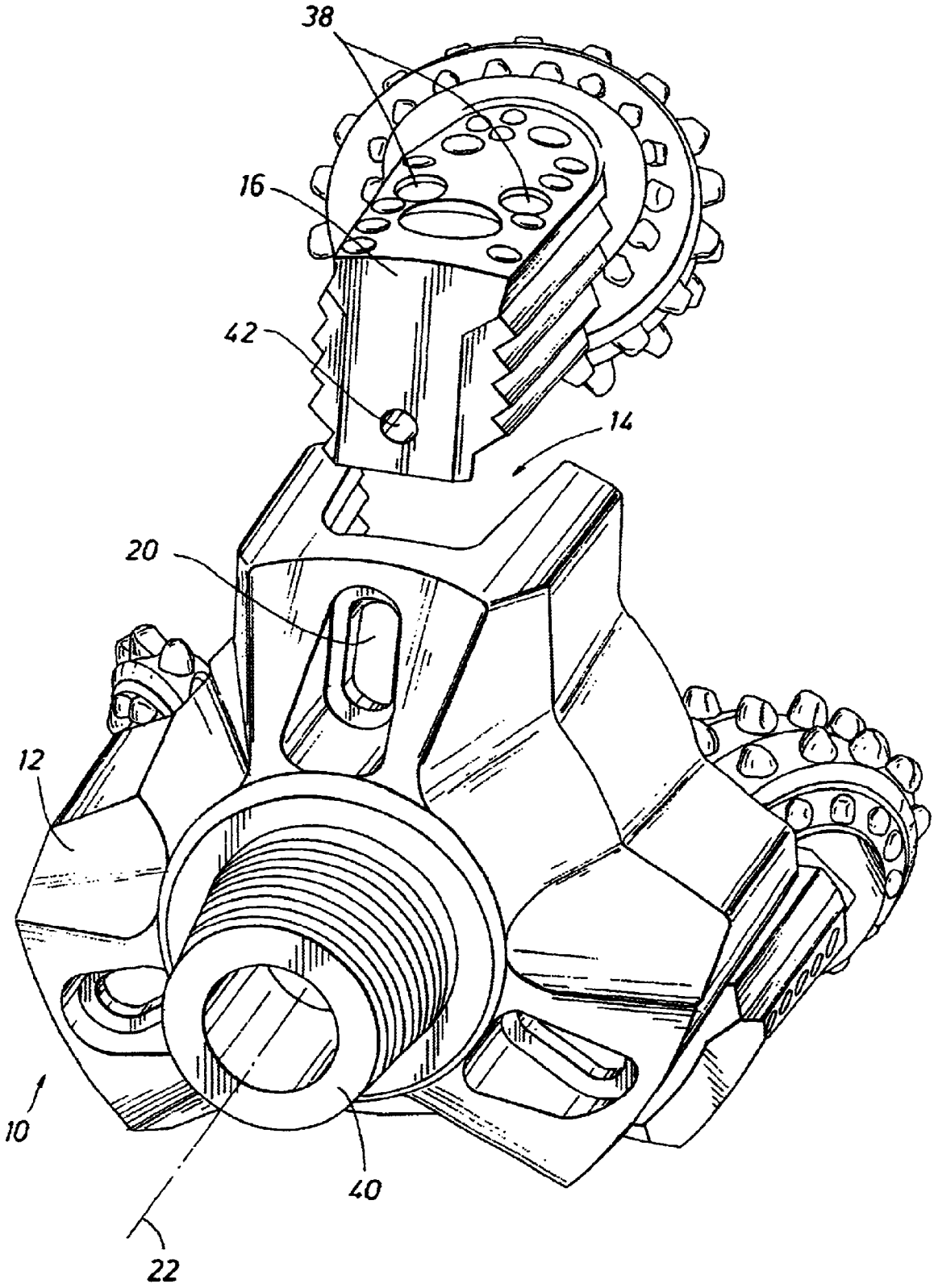
FIG. 2 is a perspective rear view of an adjustable diameter tri-cone rock bit including rolling cone cutters.
Figure 2A:
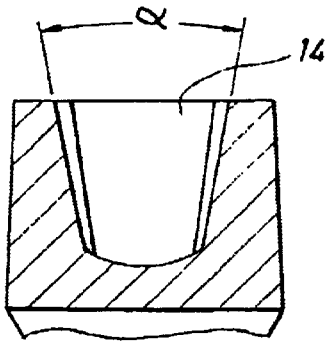
FIG. 2*a* is a top detail view of a wedge shaped pocket adapted to retain a cutter segment.

FIGS. 2 and 2*a* depict further details of the cutter mounted device of the invention. The earth boring device 10 of FIG. 2 is a tri-cone rock bit comprising the body 12 and three adjustable cutter segments 16 aligned along the axis 22 of the device 10. The tri-cone bit using the present invention would be more practical in larger size bits, such as 16"–18", 20"–24", and 32"–36". The larger bits are very expensive and the ability to have one set of pieces that could be combined to drill differing hole sizes is a big advantage. It is common to throw away bits when the cutting structure wears out because the effort to repair them is about the same as making new ones. This invention will make repair of large bits very practical. In fact, in practice the body can be used to wear out several sets of cutters.

The body includes a pin connection 40 for coupling to a drill string in the conventional manner. As previously described, the elongated slot 20 extends from the back of the pocket 14 to receive the bolt 18, permitting adjustment of the height of the cutter segment 16. The cutter segment defines a threaded hole 42 to receive the bolt 18 to retain the cutter segment tightly within the pocket.

As shown in FIG. 2*a*, the pocket 14 defines a wedge shape. The sides of the pocket form an included angle a, preferably about 10°, but may between about 5° to about 20°, if desired.

Figure 3A:
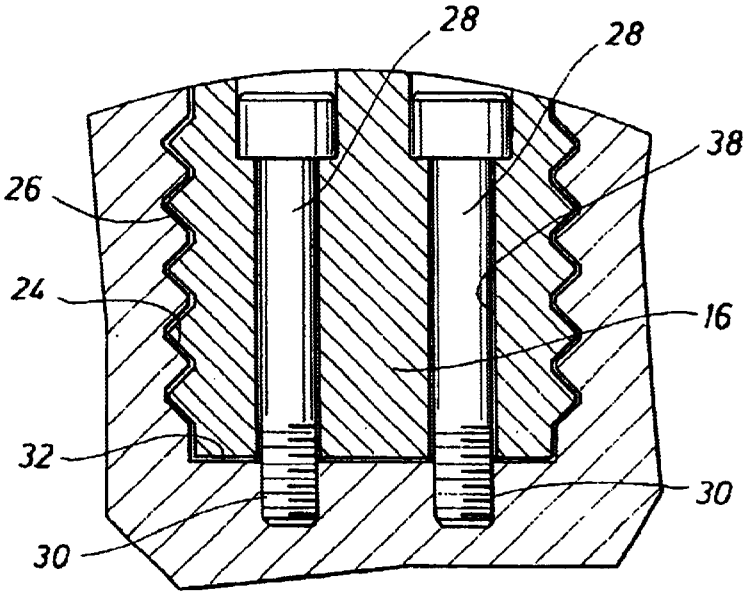
FIGS. 3*a* and 3*b* are section views of varied groove shapes.
Figure 3B:
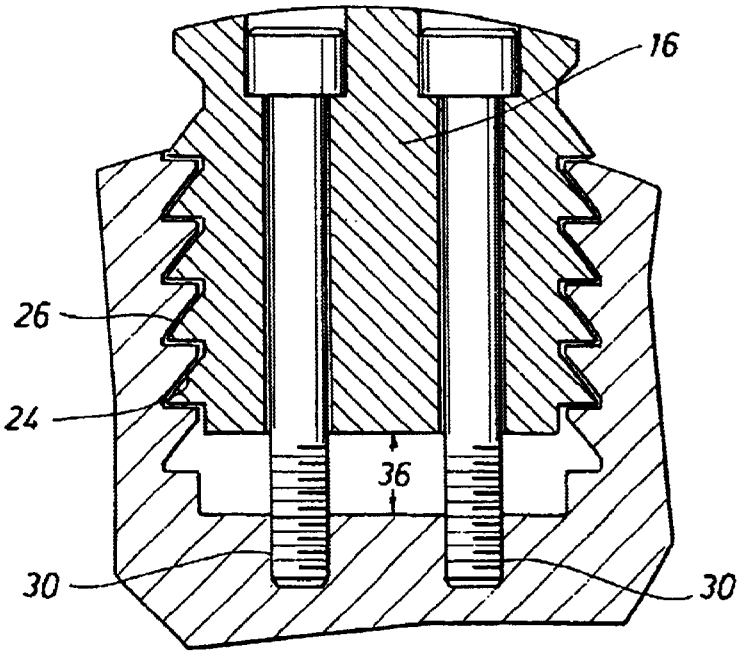

Referring now to FIGS. 3*a* and 3*b*, there are threaded holes 30 in the bottom 32 of the pocket 14 for a back up securing means. The holes 30 are adapted and aligned to receive a bolt 28 as a secondary means of securing the cutter segment into the pocket. The grooves 24 and 26 are constructed such that the segments can be mounted at differing heights from the centerline of the boring head, thus determining the diameter which the boring device will cut. The back end of the segment 16 has a threaded hole, described below with regarding to FIG. 6, for the securing bolt 18 that locks the segment into the pocket. By selecting which set of grooves 24 in the pocket the grooves 26 are to be inserted, an adjustable gap 36 is provided, thereby adjusting the height of the rolling cone cutter 34 from the axis 22, and therefore the diameter to be cut by the rolling cone cutter 34.

There are bolt holes 38 through the segment 16 to receive the bolts 28. As previously described, the main locking device is the bolt 18 that goes through the slot 20 in the back of the pocket and into the rear of the segment. When tightened it pulls the segment very securely into the pocket. After the segment is locked into place, the additional bolts 28 through segment and into the holes 30 in the bottom of the pocket provide a secondary or safety lock.

As previously described, the cutter segment is shaped like a wedge, to wedge the cutter segment 16 into the body 12 by friction fit. As with the pocket 14 previously defined, the amount of included angle is preferably about 10°, but may between about 5° to about 20°, if desired. As shown in FIG. 3*a*, the preferred shape of the milled grooves 24 in the sides of the pocket are roughly sawtooth, although as shown in FIG. 3*b* the grooves may also roughly resemble a ramp function. In the embodiment of FIG. 3*b*, the bottom of the groove is perpendicular to the force which is placed on a segment by pinching or reaming in a tight hole. Many variations of groove shapes can be made to accommodate desired size changes, manufacturing limitations and force requirements within the spirit and scope of the invention. The pitch distance from crest to crest of the grooves, i.e. the "pitch", distance is preferably about 0.5" and the pitch determines the amount of change in the bore diameter for each change in position of the segment in the pocket. Obviously, the smaller the pitch the smaller the increment of change, and therefore the finer adjustment in hole diameter.

Figure 4:
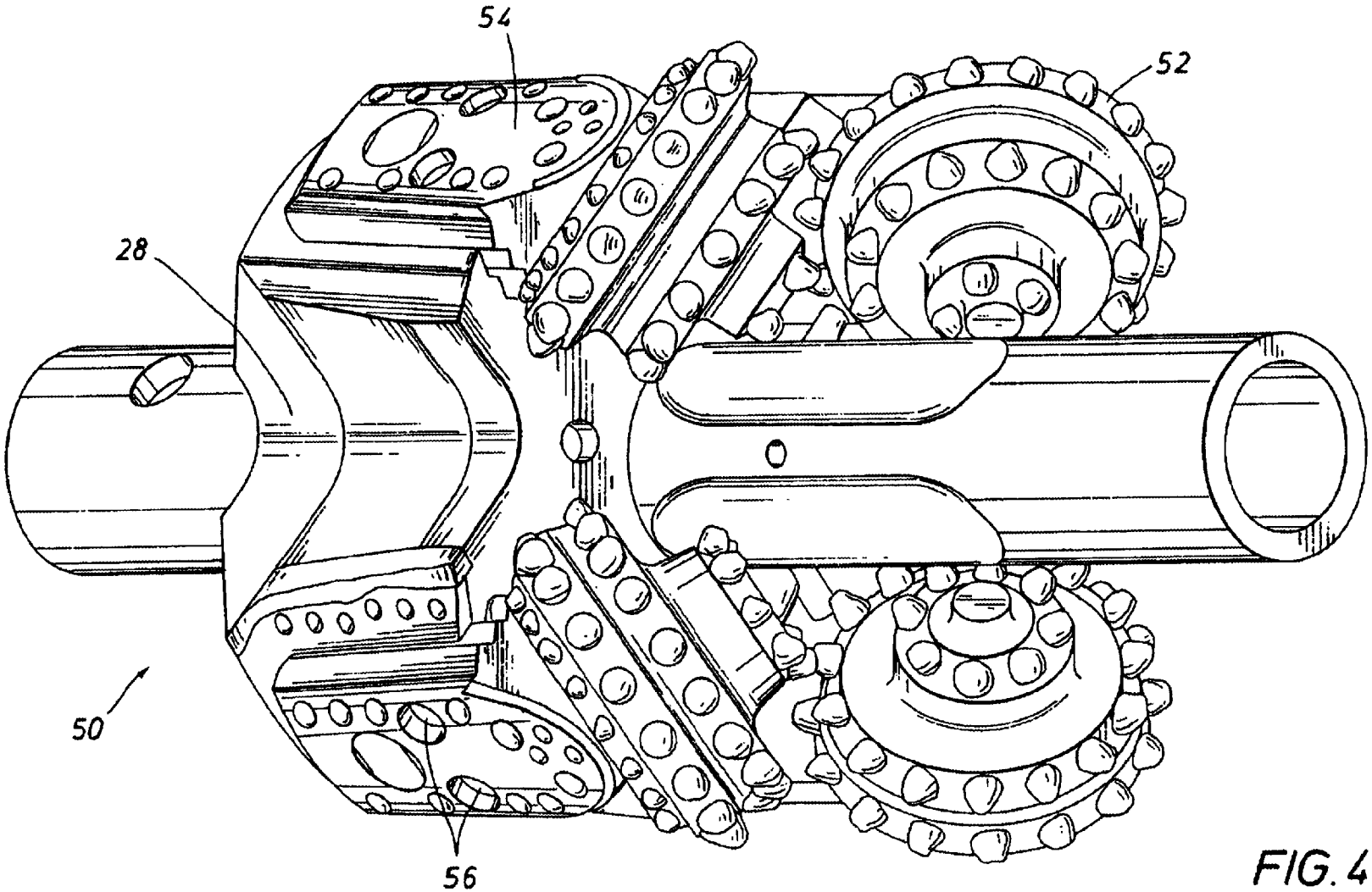
FIG. 4 is a perspective view of an adjustable diameter horizontal boring device with rolling cone cutters.

FIG. 1 illustrates the application of the invention to a general earth boring device, and FIG. 2 shows the application to a tri-cone rock bit, although other types of boring cutters can be used to match differing earth formations. For example, FIG. 4 shows an adjustable diameter horizontal boring device 50 with four rolling cone cutters 52. The rolling cone cutters are mounted on cutter segments 54 which are inserted into wedge shaped and grooved pockets as previously described with regard to FIGS. 1, 2, and 2*a*. The cutter segments are pulled in securely and locked with primary bolts from the rear and secondary locking bolts 56 through the segments. The cutter segments can be set to drill holes of several different sizes, such as for example 12" or 13" or 14" holes, according to the placement within the grooves. The ability to easily remove and install any cutter allows any single cutter to be changed out in the field in case of a cutter failure.

Figure 5:
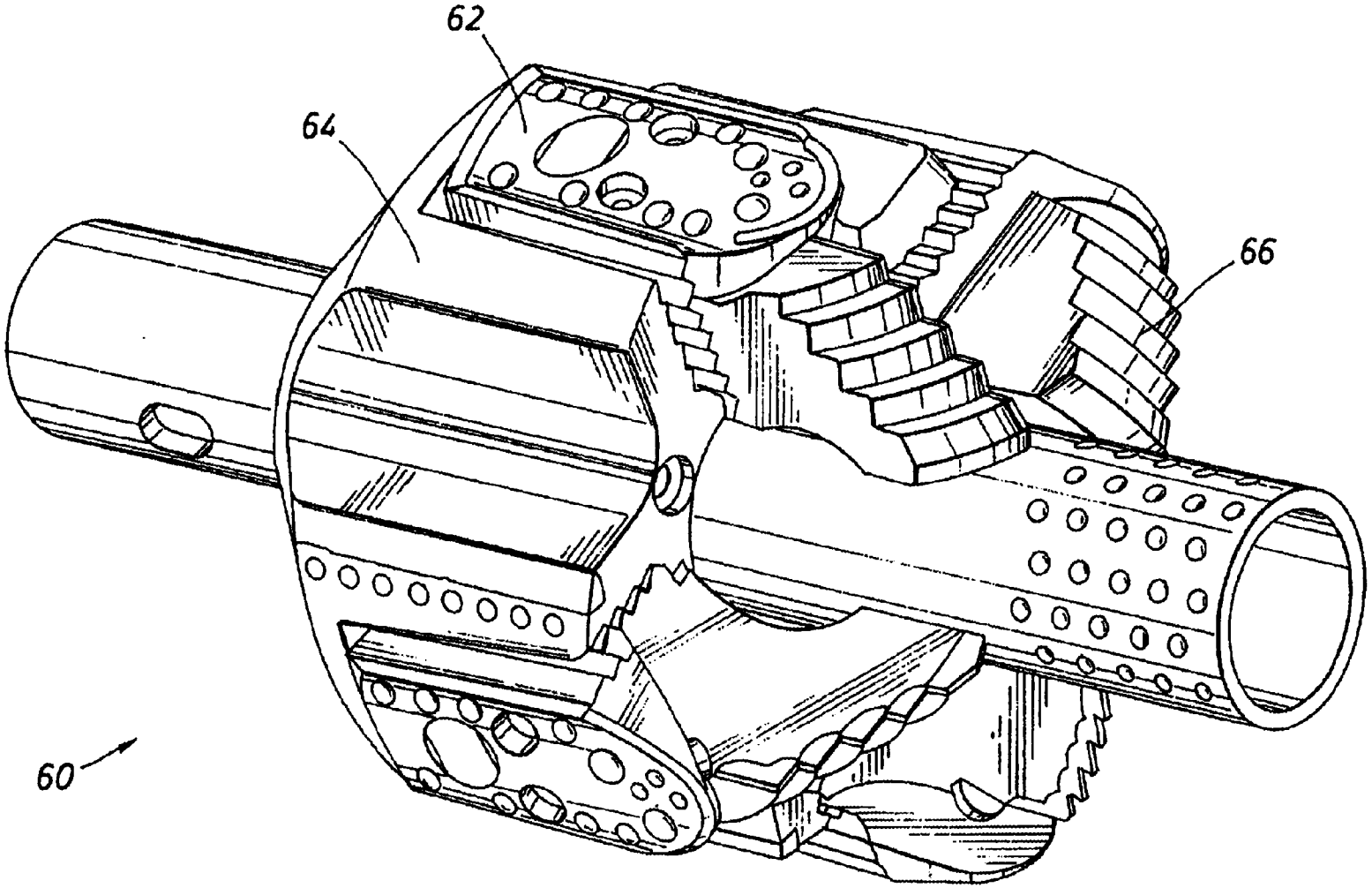
FIG. 5 is a perspective view of an adjustable diameter horizontal boring device of the invention including blade cutters.

FIG. 5 shows drag type cutters 62 on a horizontal hole opener 60 for use in softer type formations. The hole opener 60 is used primarily for enlarging a previously bored hole to a desired diameter. The hole opener 60 comprises a body 64 which defines a wedge shaped pocket as previously described and adapted to receive the cutter segment which includes the drag type cutters 62 integrally formed with the cutter segment. The cutters are formed of stepped, chevron shaped cutter blades 66 for abrading soft formations.

Figure 6:
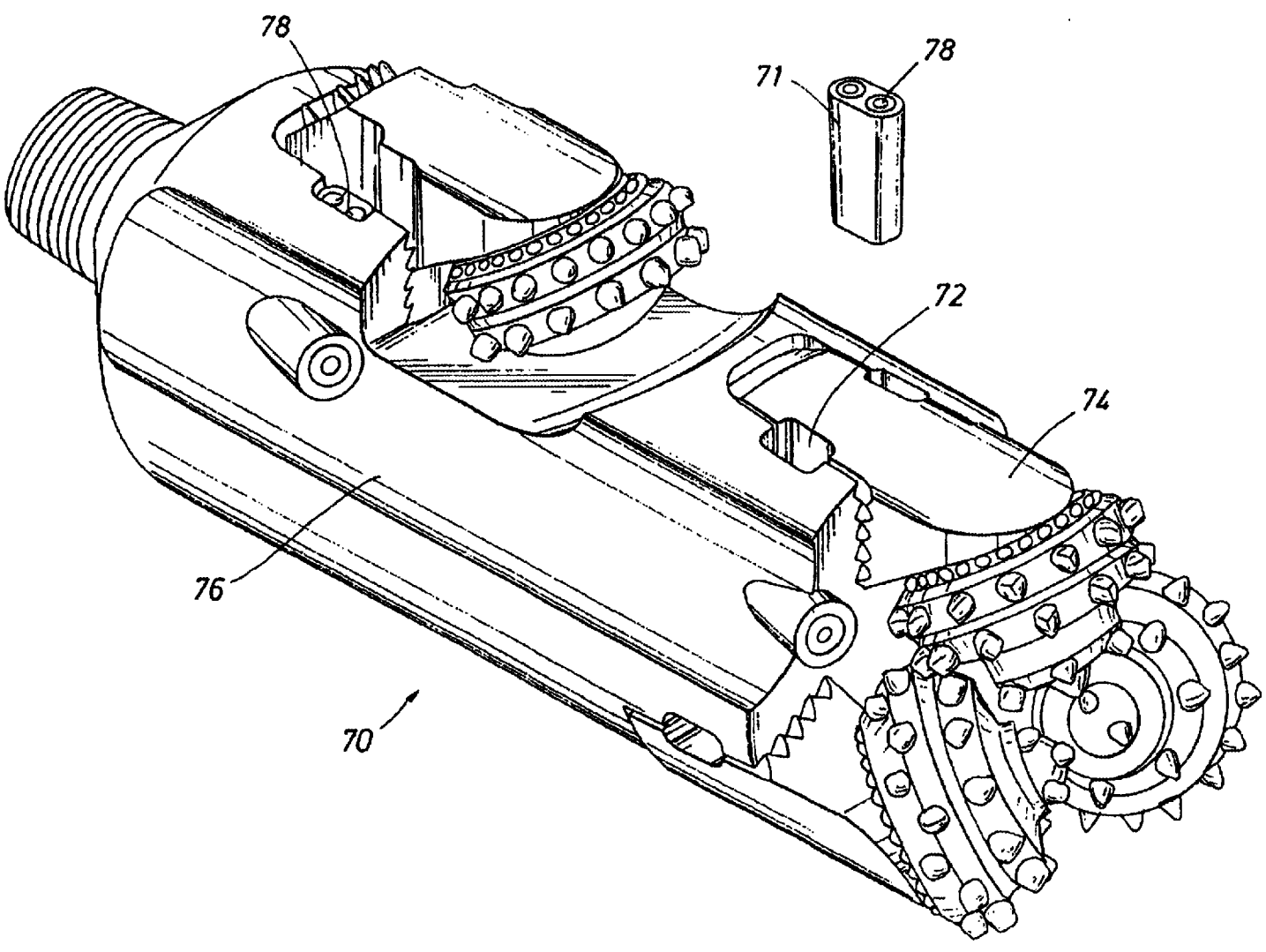
FIG. 6 is a perspective view of bi-center rock bit using adjustable cutter segments assembled in accordance with the invention.

In FIG. 6, a bi-center bit 70 is illustrated. As previously explained, locking means other than the bolts 18 and 28 may be used within the spirit and scope of the invention, and FIG. 6 illustrates such a locking means. In this application, a wedge 71 is inserted into a recess or slot 72 formed in the cutter segment 74 and the pocket 76. The wedge, once in place, may be secured with bolts 78. It is also possible to use small welds as the securing means, and in this context the term "small" means easily broken in the field, as compared to the full seam welds currently used on drilling devices.

Figure 7A:
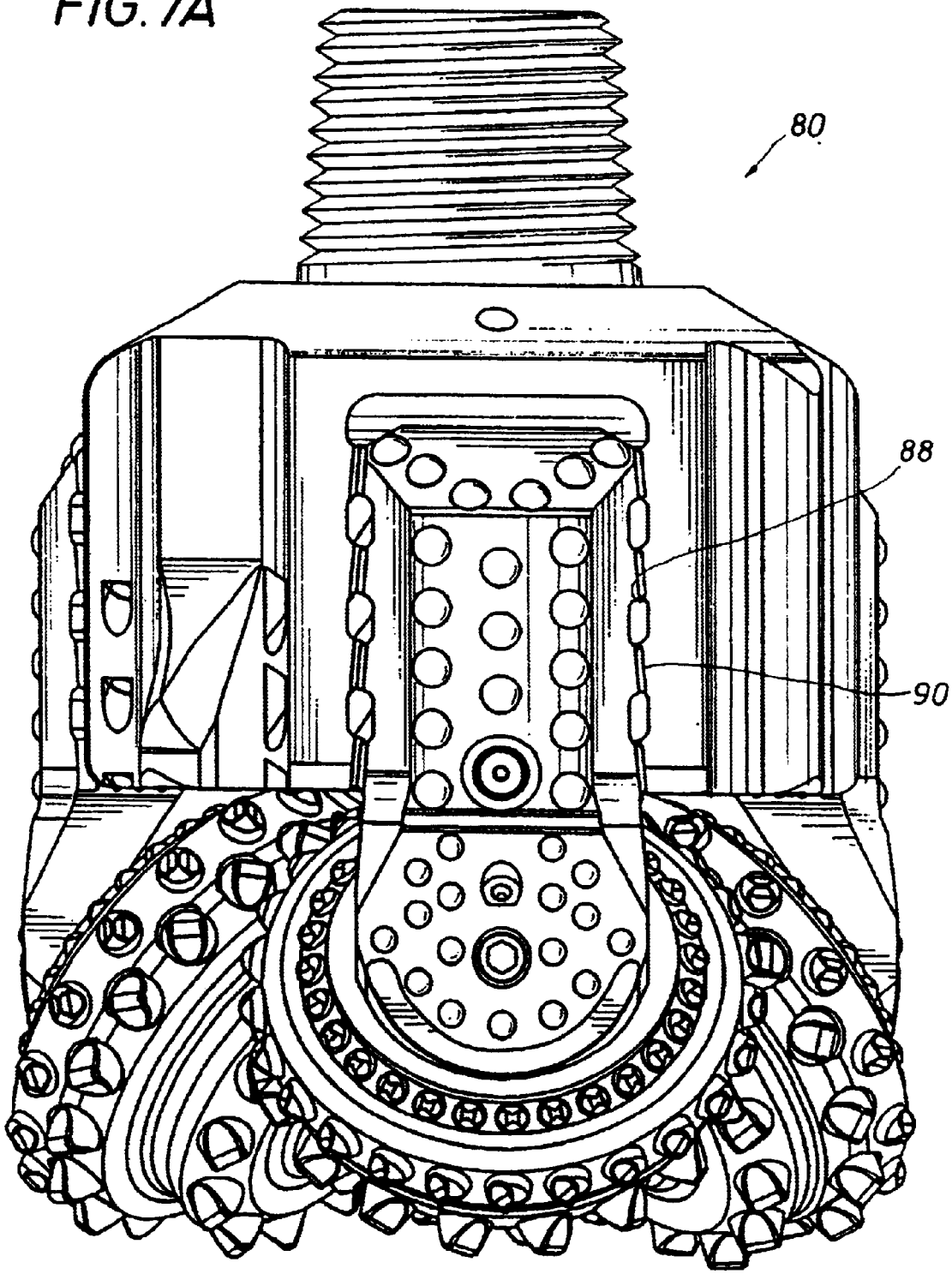
FIG. 7*a* is an elevation view of an earth boring device with replaceable segment with non-tapering sides.

FIGS. 7*a*, 7*b*, and 7*c* together illustrate another preferred embodiment of the invention. In this embodiment, an earth boring device 80 comprises a tri-cone drill bit defining a body 82 and replaceable segments 84. FIG. 7*a* depicts the earth boring device in an orientation that it would have downhole, and the lower end of the device defines a bottom of the device. The body 82 defines a pocket 86 open at the bottom and having substantially parallel sides 88, i.e. non-tapered. Similarly, the segments 84 define substantially parallel sides 90. The sides 88 of the pocket 86 define a plurality of angled threads 92 which slant inward from the bottom of the pocket upwards. The angled grooves are separated by radially oriented installation grooves 94, which are wide enough to receive a complementary set of angled threads 96 on the sides 90 of the segments. The angled threads 96 are angled in the same manner in order to frictionally mate with the threads 92 of the pocket 86. Thus, the angled threads 96 are separated by radially oriented installation grooves 98.

So, in installing the segment 84 onto the body 82, the threads 92 slide up through the installation grooves 98 and the threads 96 slide down through the installation grooves 94 to a user selectable position. Then, the segment 84 is slid upward until the respective grooves are in frictional mating fit. In order to retain the segment within the pocket, a set of retaining set screws 100 is provided, which screw down through the body onto retaining set screw flats 102 on the segments. In order to remove the segment from the pocket, an open space 104 between the top of the segment and the top of the pocket is provided. This space 104 accommodate a wedge shaped tool (not shown) which forces open the space, thereby moving the segment downward within the pocket. This action disengages the locking threads so that the threads line up with their respective installation grooves, and the segment can then be simply lifted out of the body. It is important to note that the user may select a particular set of locking threads to engage while installing the segments into the body, thereby varying the radial distance from the axis to install the segments, and thereby varying the bit diameter.

Finally, FIGS. 8*a*, 8*b*, 8*c*, and 8*d* illustrate an adaptation of the angled locking threads just described in respect of FIGS. 7*a*, 7*b*, and 7*c*, but in this instance applied to a downhole stabilizer 110. In this instance, the downhole stabilizer 110 defines a plurality of pockets 112 adapted to receive a like number of segments 114. As previously described, the pockets define locking threads 116 and installation grooves 118 and the segments define locking threads 120 and installation grooves 122. To install the segments into the body, the respective threads and installation grooves intermesh until the segment is installed to a desired radial height, and then the segments are moved upward (i.e. to the right as viewed in FIGS. 8*a* through 8*d*). In this instance, rather than the retaining set screws 100, a pair of retaining wedges 124 is provided. When the locking threads are in mating engagement, the wedges are slid down into the pocket and in abutting engagement with the segment. The wedges are then preferably screwed down in place with bolts 126 which fit into bolt holes 128 in the pocket. In order to remove and replace the segments, the top of each pocket includes a knockout hole 130, so that a simple tool (not shown) is inserted into the knockout hole to engage the top of the segment, and the segment is forced down until the locking threads of the segments and their respective pockets are disengaged.

Figure 8A:
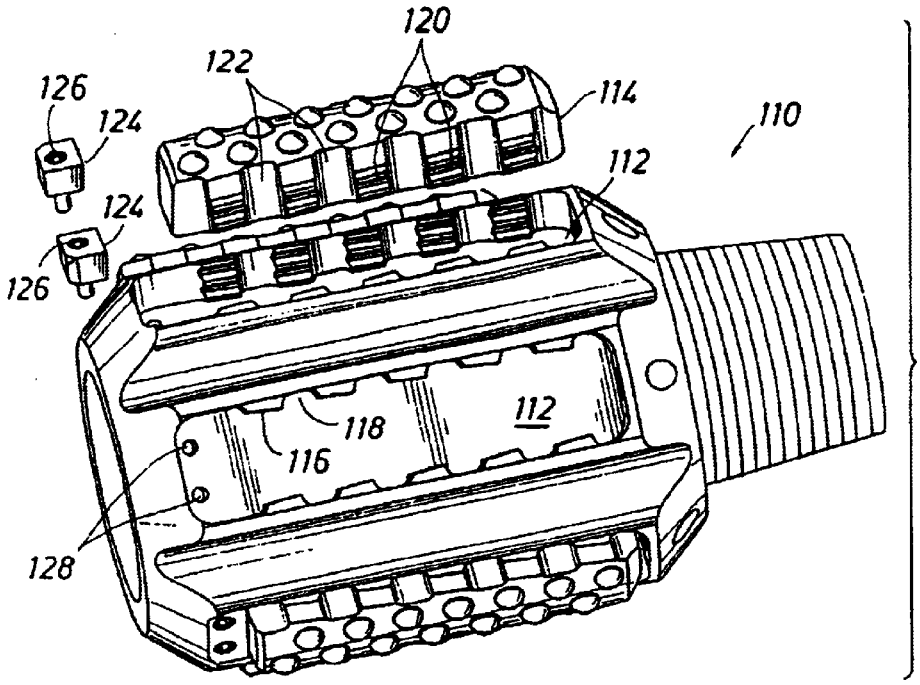
FIGS. 8*a*, 8*b*, 8*c*, and 8*d* depict various aspects of a stabilizer with replaceable and diameter adjustable segments and pockets.
Figure 8B:
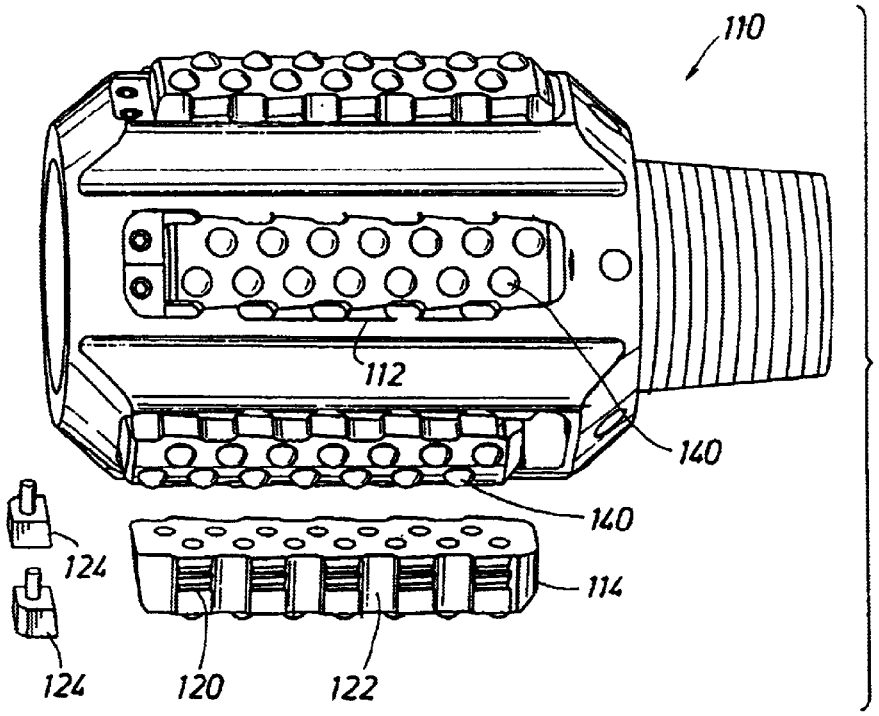
Figure 8C:
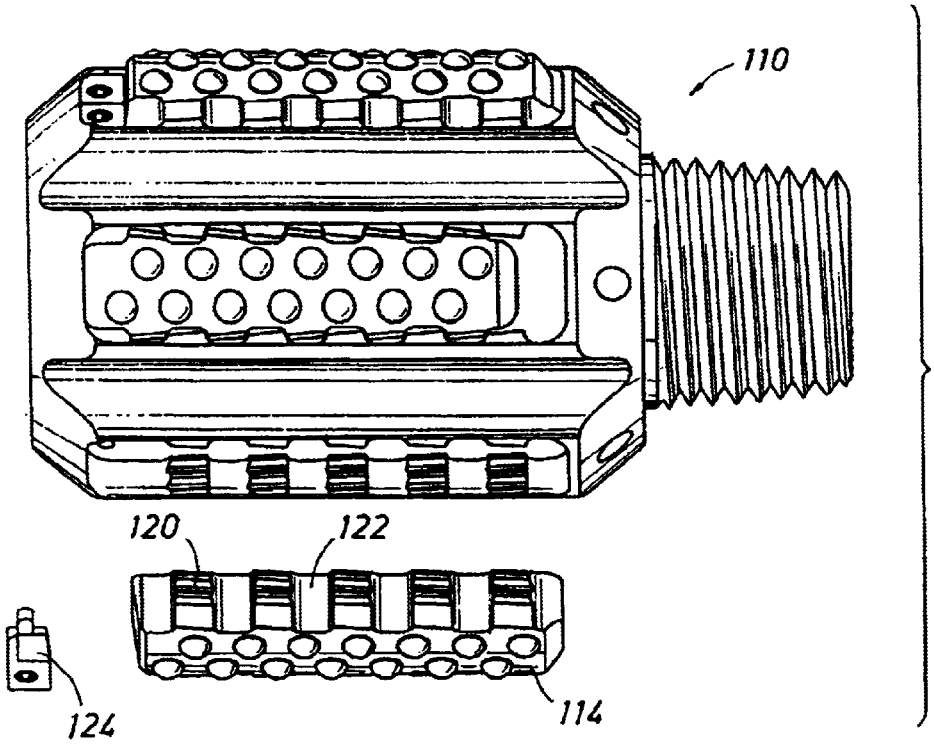
Figure 8D:
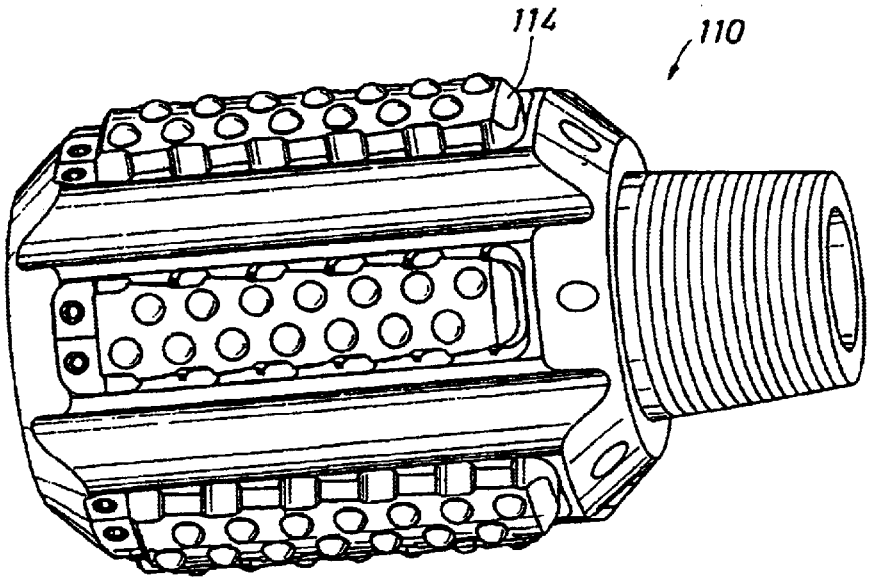

FIG. 8*b* depicts another feature of the invention, which comprises field replaceable stabilizer inserts 140. The stabilizer inserts fit into holes 142 which extend all the way through the segment 114, which defines a stabilizer pad. In order to replace an insert, the hole functions as a knockout hole, so that a simple tool (not shown) is inserted into the hole 142 to remove the insert from the segment, and a replacement insert is put into the segment in its place.

In conclusion, by employing the adjustable mounting structure of this invention, earth boring devices with matching wedged and grooved pockets and segments can be assembled to drill any of several available diameters of bore. The same body can be used with cutters of differing types to match the earth formations. Worn or failed cutters can be replaced quickly and easily allowing a body to outlast several sets of cutters. The pocket and segments with the non-tapered sides may also be employed to the same effect and with the same advantages.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An earth boring device comprising:

a. an axially oriented body defining a wedge-shaped, grooved pocket;

b. a cutter segment adapted to retain a cutter and defining a wedge-shaped, grooved portion adapted to friction fit in the pocket; and c. a rolling cone cutter element mounted on the cutter segment.

2. The earth boring device of claim 1, wherein the rolling cone cutter element is integrally formed with the cutter segment.

3. The earth boring device of claim 1, wherein the pocket defines a plurality of laterally extending pocket grooves and wherein the cutter segment defines a plurality of laterally extending cooperating grooves adapted to mate with the pocket grooves, thereby defining a variable distance between the cutter element and the axis of the body.

4. The earth boring device of claim 1, further comprising means for securing the cutter segment to the body.

5. The earth boring device of claim 4, wherein the means for securing the cutter segment to the body comprises:

a. an elongated slot through the body into the pocket;

b. a threaded hole in the cutter segment in line with the elongated slot; and c. a bolt through the slot into the threaded hole.

6. The earth boring device of claim 4, wherein the means for securing the cutter segment to the body comprises:

a. a threaded hole in the body;

b. a hole through the cutter segment in line with the hole in the body; and c. a bolt through the hole in the cutter segment and threaded into the threaded hole.

7. The earth boring device of claim 4, wherein the means for securing the cutter segment to the body comprises:

a. a recess in the cutter segment;

b. a complementary recess in the body adapted to form a space; and c. a wedge in the space.

8. The earth boring device of claim 7, further comprising a bolt to secure the wedge to the body.

9. The earth boring device of claim 1, wherein the pocket defines an included angle of between about 5° and about 20°.

10. The earth boring device of claim 8, wherein the pocket defines an included angle of about 10°.

11. The earth boring device of claim 1, wherein the earth boring device is a tri-cone drill bit.

12. The earth boring device of claim 1, wherein the earth boring device is an adjustable diameter horizontal boring device.

13. A downhole device comprising:

a. an axially oriented body defining a pocket having axially extending locking pocket threads separated by radially extending installation pocket grooves; and b. a segment having mating axially extending locking segment threads separated by radially extending installation segment grooves adapted for frictional fit with the pocket threads.

14. The device of claim 13, wherein the device defines a drill bit.

15. The device of claim 13, wherein the device defines a stabilizer.

16. The device of claim 13, further comprising a knockout hole through the body into the pocket.

17. The device of claim 13, wherein the segment defines a stabilizer pad having replaceable inserts.

18. The device of claim 13, further comprising a retaining wedge adapted for abutting engagement with the segment and the pocket.

19. The device of claim 13, further comprising:

a. a retaining set screw adapted to screw through the body; and b. a retaining set screw pad on the segment for abutting engagement with the retaining set screw to retain the segment within the pocket.

20. An earth boring device comprising:

a. an axially oriented body defining a wedge-shaped, grooved pocket;

b. a cutter segment adapted to retain a cutter and defining a wedge-shaped, grooved portion adapted to friction fit in the pocket; and c. a blade cutter element mounted on the cutter segment.

* * * * *